United States Patent [19]

McCorvey

[11] 4,395,894

[45] Aug. 2, 1983

[54] AUTOMATIC CLOSING MACHINE FOR SHEET METAL JOINTS

[76] Inventor: Allan F. McCorvey, 10702 Munn, Jacinto City, Tex. 77029

[21] Appl. No.: 291,235

[22] Filed: Aug. 10, 1981

[51] Int. Cl.[3] ..... B21D 31/06; B21D 39/02; B23P 11/00

[52] U.S. Cl. ..... 72/76; 72/21; 72/125; 72/368; 29/243.58; 29/463; 29/514

[58] Field of Search ..... 29/243.5, 243.58, 463, 29/514; 413/72–75, 77; 72/76, 21, 125, 368, 309, 293, 316, 51, 49, 52; 269/49

[56] References Cited

U.S. PATENT DOCUMENTS

| | | | |
|---|---|---|---|
| 1,612,519 | 12/1926 | Lindgren | 72/51 |
| 1,805,261 | 5/1931 | Roberts et al. | 72/51 |
| 2,621,621 | 12/1952 | Kaiser | 72/51 |
| 2,696,182 | 12/1954 | Hoenninger et al. | 72/51 |
| 3,003,446 | 10/1961 | Ely et al. | 72/51 |
| 3,487,669 | 1/1970 | Kemp | 72/76 |
| 3,638,596 | 2/1972 | Kemp | 72/76 |

*Primary Examiner*—Lowell A. Larson
*Attorney, Agent, or Firm*—Neal J. Mosely

[57] ABSTRACT

An automatic closing machine for sheet metal joints in sheet metal ducts or the like consists of a powered rotary hammer for continuous application of a hammering force to the edge portion of a joint to be formed to fold such edge into a closed joint. A supporting frame with a vertically adjustable support permits varying the relative vertical spacing of the edge of the duct and the rotary hammer. Stops locate the duct longitudinally to set the length of the joint relative to the location of the end connecting edges of the duct. Pneumatic clamps secure the duct accurately for forming the joint by the rotary hammer. A track supports the rotary hammer for longitudinal movement and an automatic traversing mechanism moves the rotary hammer therealong. The traversing mechanism automatically moves the rotary hammer back and forth along the track. The vertical adjustment locates the edge of the unformed duct properly relative to the path of movement of the rotary hammer for any selected duct size. Likewise, the traversing mechanism controls may vary the distance of movement of the rotary hammer for any selected duct length. The apparatus is satisfactory for forming both one-piece duct joints and two-piece duct joints.

16 Claims, 10 Drawing Figures

AUTOMATIC CLOSING MACHINE FOR SHEET METAL JOINTS

BACKGROUND OF THE INVENTION

1. Field of the Invention

This invention relates to new and useful improvements in machines for working sheet metal, particularly for closing sheet metal joints of the type commonly known as the "Pittsburgh Lock", and more particularly to an automatic machine for continuous application of a hammering force to the edge portion of a joint to be formed to fold such edge into a closed joint.

2. Description of the Prior Art

In the past, the formation of sheet metal joints in duct work has been done by hand or by complicated machinery for rolling and forming the desired seams or joints.

Lindgren U.S. Pat. No. 1,612,519 discloses an automatic seaming machine for sheet metal having rotary cams for folding and bending seams.

Brown U.S. Pat. No. 1,381,062 discloses a rotary brake for forming seams in sheet metal products.

McCann U.S. Pat. No. 1,625,269 discloses an automatic seaming device for cylindrical objects such as cans.

Flagler U.S. Pat. No. 2,950,697 discloses a rotary device for forming seams in sheet metal.

Tribe U.S. Pat. No. 3,130,770 discloses a rotary device for bending or folding the edges of sheet metal panels to form seams therein.

Gibson U.S. Pat. No. 2,810,420 discloses a rotary hammer for closing sheet metal joints of the type known as the "Pittsburgh Lock".

Kemp U.S. Pat. No. 3,638,596 discloses another type of rotary hammer for closing sheet metal joints of the type known as the "Pittsburgh Lock".

SUMMARY OF THE INVENTION

One of the objects of this invention is to provide a new and improved automatic closing machine for sheet metal joints and particularly for folding or closing joints known as the "Pittsburgh Lock".

Another object of this invention is to provide a new and improved automatic closing machine for sheet metal joints having a powered rotary hammer for continuous application of a joint-folding hammering force.

Another object of this invention is to provide an improved automatic closing machine for sheet metal joints having a rotary hammer and means for moving the hammer along the length of the joint to be formed and returning to the starting place.

Another object of the invention is to provide an improved automatic closing machine for sheet metal joints having vertical adjustment for varying the relative position of the edge of the duct in which the joint is to be formed and the rotary hammer.

Another object of the invention is to provide an improved automatic closing machine for sheet metal joints having stops to locate the sheet metal duct longitudinally in the machine to predetermine the location of the joint in relation to the location to the end connecting edges of the duct.

Another object of the invention is to provide an improved automatic closing machine for sheet metal joints having automatic controls for moving a rotary hammer a predetermined distance and then reversing direction.

Another object of this invention is to provide an improved automatic closing machine for sheet metal joints which may be used for joints in one piece and two piece sheet metal ducts.

Other objects of the invention will become apparent from time to time throughout the specification and claims as hereinafter related.

The foregoing objects and other objects of the invention are accomplished by an automatic closing machine for sheet metal joints in sheet metal ducts or the like which consists of a powered rotary hammer for continuous application of a hammering force to the edge portion of a joint to be formed to fold such edge into a closed joint.

The machine has a supporting frame with a vertically adjustable support for varying the relative vertical spacing of the edge of the duct in which the joint is to be formed and the rotary hammer. Stops locate the duct longitudinally in the machine to predetermine the length of the joint being folded in relation to the location of the end connecting edges of the duct. Pneumatic clamps or the like are provided to secure the duct accurately in position for formation of the joint by the rotary hammer.

A longitudinally extending track is provided on the machine on which the rotary hammer is supported for longitudinal movement and an automatic traversing mechanism is provided to move the rotary hammer along the track. Automatic controls are provided to actuate the traversing mechanism to move the rotary hammer along the track a predetermined distance and then to reverse direction.

Vertical frame adjustment is operable to locate the edge of the duct which is to be formed into a joint in proper position in relation to the path of movement of the rotary hammer for any selected duct size. Likewise, the controls for the traversing mechanism may vary the length of the path of movement of the rotary hammer for any selected duct length. The apparatus is useful for forming joints in one-piece ducts having a single joint and for forming joints in two-piece joints having two joints on opposite sides thereof.

DESCRIPTION OF THE PREFERRED EMBODIMENT

Figure 1:
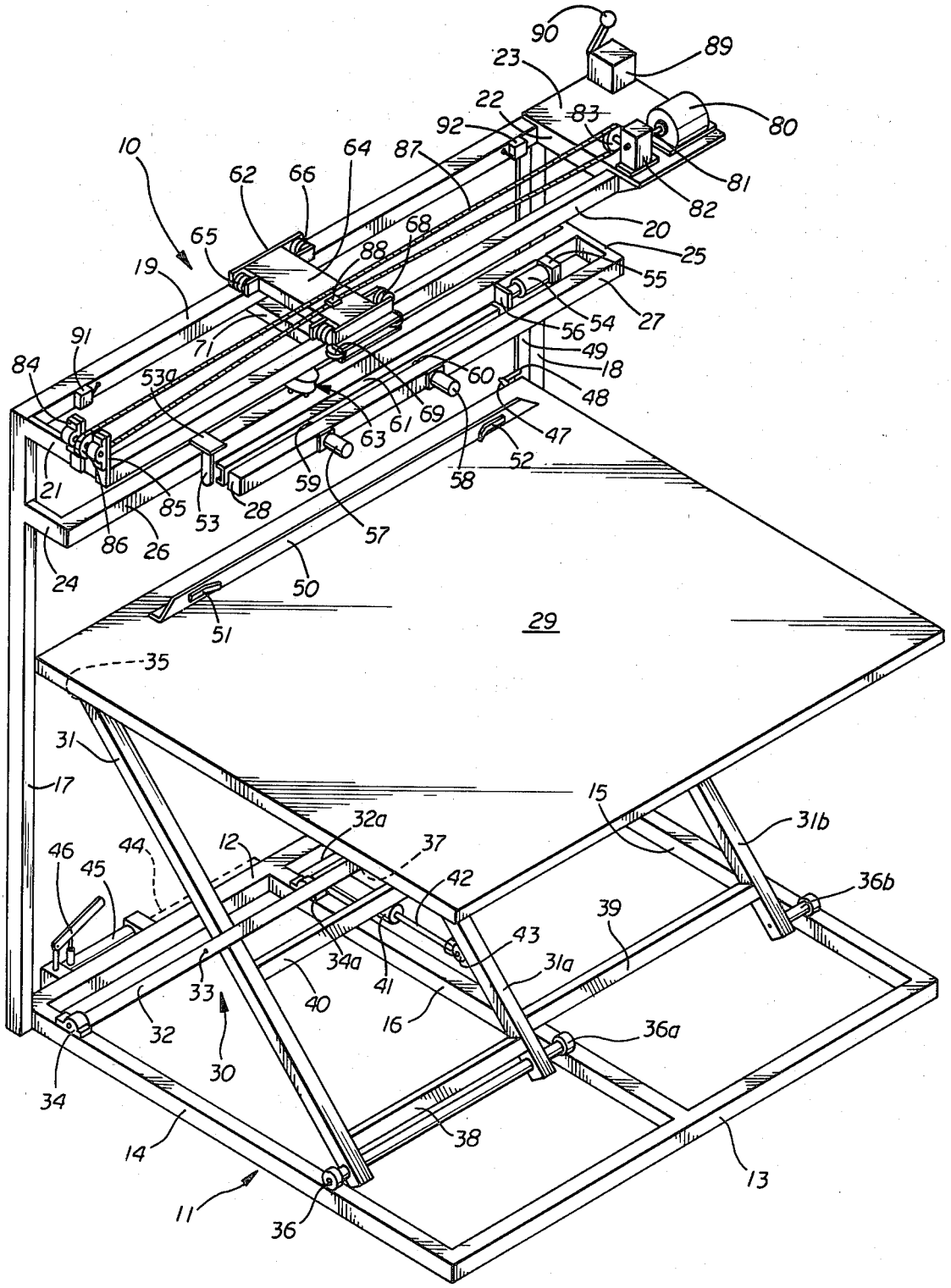
FIG. 1 is an isometric view of a preferred embodiment of an improved automatic closing machine for sheet metal joints.

Referring to the drawings by numerals of reference and more particularly to FIGS. 1 to 4, there is shown an automatic closing machine 10 for sheet metal joints in sheet metal ducts or the like. The machine 10 is particularly designed for bending and closing sheet metal seams of the type known as the "Pittsburgh Lock".

Machine 10 consists of a base frame 11 formed of end pieces 12 and 13 and side pieces 14 and 15 and center brace 16. Frame 11 is preferably formed of square tubing secured together by welding. Frame 11 also includes vertically extending supports 17 and 18 of square tubing or the like secured on the base support by welding.

At the upper end of vertical supports 17 and 18 there is provided a longitudinally extending, supporting track consisting of longitudinally extending bars or rails 19 and 20. Rails 19 and 20 are preferably of square tubing as is the rest of the structure. Rail 19 extends between vertical supports 17 and 18. Rail 20 extends between outwardly projecting legs 21 and 22 which are welded on rail 19. Rails 19 and 20 and leg 22 also function as supports for a small supporting plate or platform 23.

Just below the top of the frame, there are positioned a pair of outwardly extending supporting legs 24 and 25 which are welded to vertical supporting legs 17 and 18. A transversely extending square tubular member 26 is secured at one end to supporting leg 24 and at the other end to supporting leg 25. A cantilevered supporting member 27 is secured at one end to supporting leg 25 and is unsupported at its distal end 28. The upper portions of the frame, just described, support the clamping and automatic rotary hammer used in the apparatus as will be subsequently described.

The apparatus is provided with a vertically movable table or support 29 for supporting sheet metal duct work in operating relation to the rotary hammer carried on the upper portion of the frame. Table 29 is provided with a scissors type support which enables the table to be positioned accurately in any selected vertical position without shifting laterally. Scissors type support 30 consists of a pair of supporting arms 31 and 32 which are pivotally connected by pivot pins 33. The lower end of supporting arm 32 is pivotally supported on pivot 34.

The upper end of supporting arm 31 is pivotally supported on the underside of table 29 on a pivot 35 which is hidden but is the same type of pivot as pivot 34. The lower end of supporting arm 31 is provided with a supporting roller 36 which is movable along the upper surface of square tubing 14 at the bottom portion of frame 11. The upper end of supporting arm 32 is provided with a roller 37 which is hidden but which identical to roller 36 and rides along the under surface of supporting table 29.

The scissors type support 30 also includes parallel supporting arms which are supported on and ride on the square tubes 15 and 16 of the base portion of supporting frame 11. Supporting arm 32*a* is supported on pivot 34*a* and is provided with a roller at its upper end which corresponds to roller 37 on supporting arm 32. Supporting arm 31*a* has roller 36*a* at its lower end which rides on square tubing 16. Supporting arm 31*a* is connected to the underside of table 29 by a pivot which corresponds in position to pivot 35 for supporting arm 31. Supporting arms 31 and 32*a* are pivotally joined by a pivot pin corresponding to pivot pin 33 connecting arms 31 and 32.

Supporting arm 31*b* has a supporting roller 36*b* which rides on the upper surface of square tubing 15. Supporting arm 31*b* intersects and is pinned to a supporting arm which corresponds to supporting arms 32 and 32*a*. That supporting arm is hidden in the view shown in FIG. 1 but is pivotally connected on square tubing 15 on the base portion of supporting frame 11. Supporting arm 31*b* is pivotally connected to the underside of table 29 in the same manner as supporting arms 31 and 32*a*. A brace 38 is welded between supporting arms 31 and 31*a*. A second brace 39 is welded in place between supporting arms 31*a* and 31*b*. Another brace 40 is welded in place between supporting arms 31 and 31*a*. A further brace, which is hidden in this view, is welded in place between supporting arms 31*a* and 31*b* in a position representing substantially an extension of brace 40.

The scissors type support 30 for table 29 is operable to raise and lower table 29 by extension of the lower ends of arms 31, 31*a* and 31*b* which causes the support to lower the table and by retraction of arms 31, 31*a* and 31*b* causes the table to be raised in a vertical direction without any lateral deviation. The scissors support is operated by hydraulic cylinder 41 which is pivotally supported at its base on the pivot 34*a* and which has a piston 42 which is pivoted as at 43 to the middle supporting arm 31*a* of the scissors type support 30.

Hydraulic cylinder 41 is connected by hydraulic line 44 to a manual hydraulic pump 45 having an operating handle 46. The hydraulic pump and hydraulic cylinder 41 may, if desired, be double acting so that hydraulic pressure can be used for lowering as well as raising table 29. In most cases, however, a single acting pumping arrangement would be satisfactory since the table 29 can be lowered by gravity and allowing the hydraulic pressure to bleed back into the pumping cylinder 45. Table 29 is provided with an extension 47 with an indicator 48 movable along indicia 49 on vertical supporting arm 18. Indicator 48 reading on indicia 49 indicates the precise elevation of table 29 in English or metric units.

On the upper side of supporting table 29 there is affixed a stop member 50 which is of angle iron and has stop guides 51 and 52 at opposite ends. Stop member 50 is aligned and coplanar with supporting bar 26 on the upper portion of frame 11. A stop 53, hinged at 53*a*, is positioned on supporting bar 26 and is vertically aligned with stop 51 on stop member 50. Stops 51 and 53 locate the end of a sheet metal duct which is to be positioned in the apparatus for bending or closing a seam or joint therein. A pneumatic spring device 54 is supported on an abutment or flange 55 on support 26 and has an end plate 56 which is engageable with one end of a sheet metal duct which is to be positioned in the apparatus and is operable to force the duct into engagement with stop 53.

A pair of fluid operated cylinders 57 and 58 are supported on cantilevered supporting arm 27. Cylinders 57 and 58 may be pneumatically operated or hydraulically operated. If desired, cylinders 57 and 58 could be replaced by any suitable mechanical clamping mechanism. Cylinders 57 and 58 have pistons 59 and 60 which have secured on their outer ends a channel-shaped clamping member 61. Clamping member 61 is movable by cylinders 57 and 58 into clamping engagement with sheet metal which is to be clamped against the front vertical surface of supporting member 26. The connections from cylinders 57 and 58 to their source of fluid pressure and the controls for turning that pressure on and off are not shown but conventional connections and controls are used.

Figure 2:
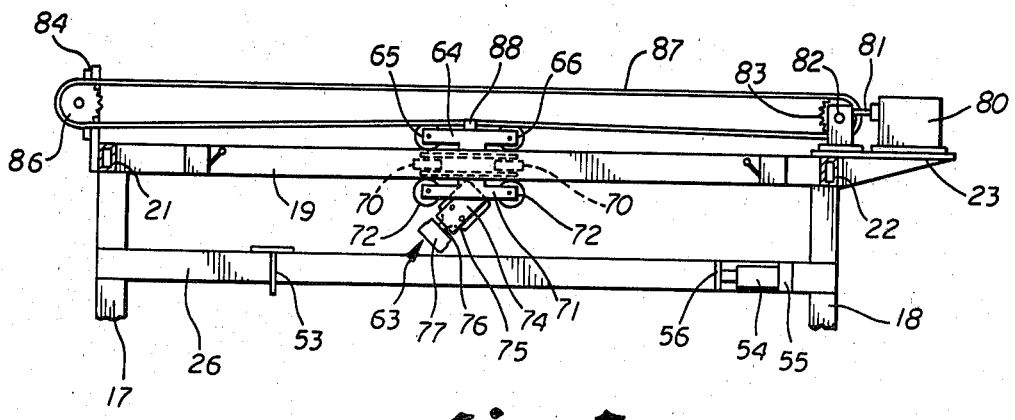
FIG. 2 is a detail view in elevation showing the traversing mechanism for a rotary hammer in the embodiment of the invention shown in FIG. 1.
Figure 3:
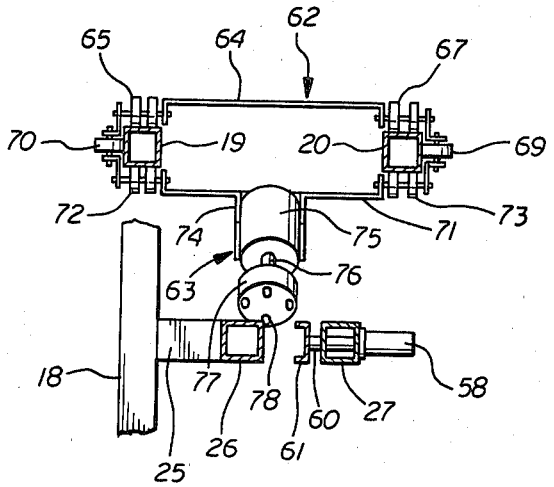
FIG. 3 is a sectional view showing the positioning of the traversing mechanism and supporting track for the rotary hammer and its relation to the clamping mechanism for the sheet metal in which a joint is to be closed.
Figure 10:
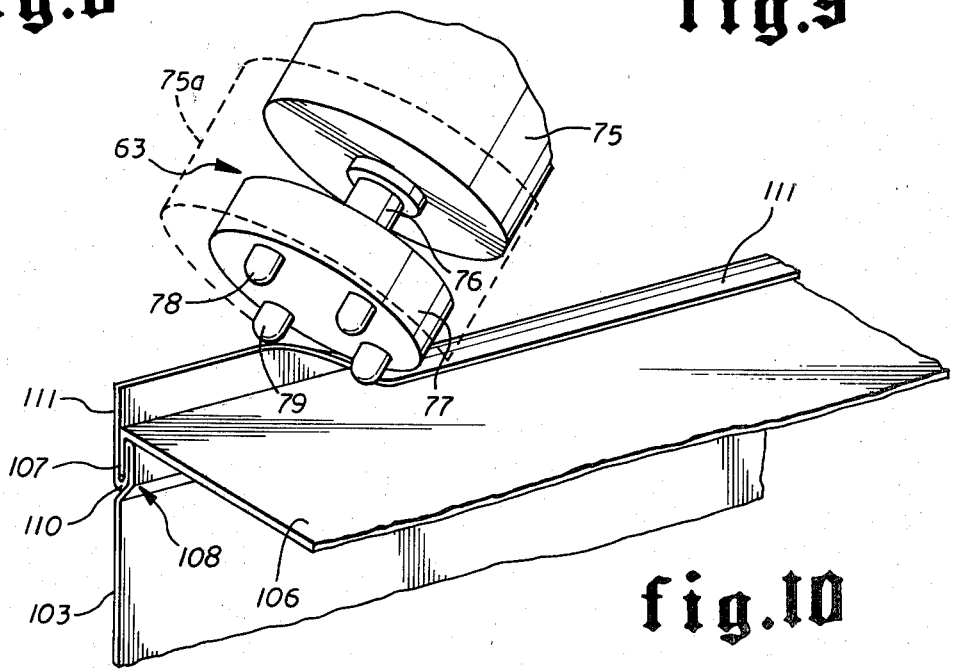
FIG. 10 is an isometric view of the rotary hammer on the apparatus shown in FIGS. 1 to 3 in position bending over the edge of the sheet metal of a "Pittsburgh Lock".

On the upper part of the frame 11 there is provided a carriage 62 which supports a rotary hammer 63, seen in greater detail in FIGS. 2, 3 and 10. Supporting carriage 62 has an upper, channel-shaped housing 64 which extends laterally between upper supporting rails 19 and 20. Channel-shaped housing 64 is provided with wheels 65 and 66 which roll along the upper surface of supporting rail 19 and wheels 67 and 68 which roll along the upper surface of supporting rail 20 and outwardly extending wheels or rollers 69 ride on the vertical face or surface of supporting rail 20 and a corresponding set of wheels or rollers 70 ride on the vertical face or surface of supporting rail 19.

A lower channel-shaped carriage housing 71 supports rotary hammer 63 and is secured to upper housing 64 as seen in FIGS. 2 and 3. Lower houding 71 is provided with two pairs of wheels 72 which ride on the lower surface of supporting rail 19 and two pairs of wheels 73 which ride on the lower surface of supporting rail 20. The wheels of carriage 62 surround the supporting rails 19 and 20, respectively, on three sides and prevent the carriage from becoming derailed. Rotary hammer 63 is supported on bottom carriage housing 71 by bracket 74.

Rotary hammer 63 consists of motor 75, with guard 75*a*, which is preferably a fluid actuated motor although an electrically powered motor could be used if desired. Motor 75 is provided with rotary shaft 76 which supports a rotary disc 77 having a plurality of hammer abutments 78 thereon. Hammer abutments 78 are preferably cylindrical studs which are threaded into supporting plate 77 and having rounded head portions 79 in operation, motor 75 rotates shaft 76 and disc 77 at a high rate of speed and causes hammer abutments 78 to strike continuous and sequential hammer blows for bending a sheet metal edge to close a "Pittsburgh Lock" joint as will be subsequently described.

At the right end of the machine, as seen in FIGS. 1 and 2, supporting plate 23 supports motor 80 which is preferably the same type of motor as the motor 74 for rotary hammer 63. Thus, if a pneumatic motor is used for rotary hammer 63, a pneumatic motor would likewise be used for motor 80. Motor 80 is connected by shaft 81 to gear box 82 which drives sprocket 83. At the other end of the machine, brackets 84 and 85 support sprocket 86. A drive chain 87 is positioned around and extends between sprockets 83 and 86. Chain 87 is secured to the upper housing portion 64 of carriage 62 as indicated at 88.

Control 89, with operating handle 90, is supported on supporting platform 23. Operation of handle 90 causes control 89 to energize motor 80 to operate chain 87 in a forward (clockwise) direction moving carriage 62 from right to left as seen in the apparatus. At the left end of the machine, a limit switch 91 is supported on supporting arm 19. When carriage 62 engages limit switch 91, motor 80 is switched to a reverse position, by a conventional control system of electric relays which are not shown. This causes motor 80 to rotate sprocket 83 in a counterclockwise direction and return carriage 62 from left to right to its place of origin. At the right end of the apparatus, limit switch 92 is engaged by carriage 62 on returning movement to turn off motor 80.

Figure 4:
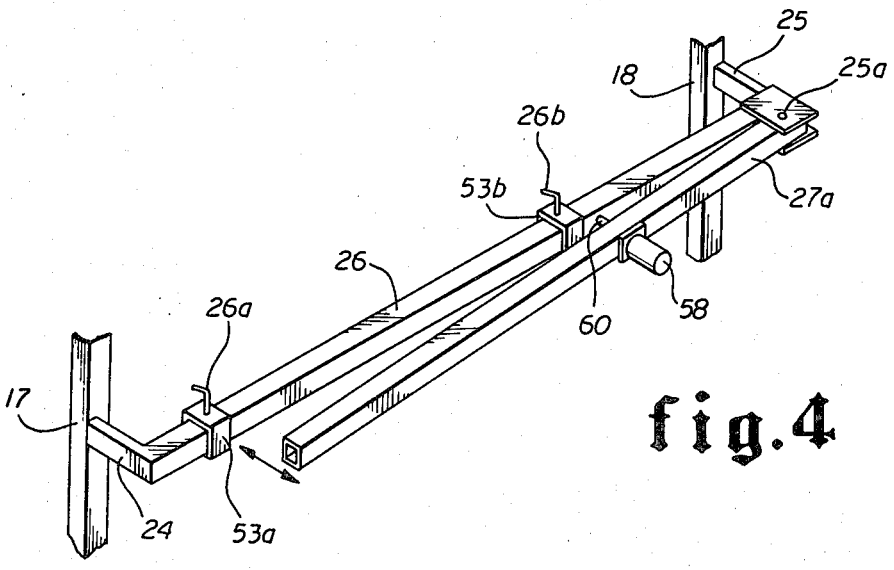
FIG. 4 is an isometric view of the clamping mechanism showing an alternate form of clamp.

In FIG. 4, there is shown an alternate clamping arrangement for clamping sheet metal duct in position for closing a "Pittsburgh Lock" by use of the automatic rotary hammer described above. In this embodiment, cantilevered arm 27*a* is pivotally supported as indicated at 25*a*. Pressure operated cylinder 58 has its piston 60 operatively connected to supporting arm 26 so that operation of cylinder 58 will pivot arm 17*a* into or out of clamping engagement. Stops 53*a* and 53*b* are slidably adjustable on supporting arm 26 and are provided with set screws 26*a* and 26*b*.

OPERATION

In order to understand the operation of this automatic joint or seam closing machine, it is desirable to examine the nature of the "Pittsburgh Lock". In FIGS. 5 to 9, there are shown example of the "Pittsburgh Lock" as used in duct work of a one piece construction and a two piece construction, respectively. In FIG. 10, there is shown a detail, isometric view of the rotary hammer in the process of bending over the edge of the sheet material to close the "Pittsburgh Lock".

Figure 5:
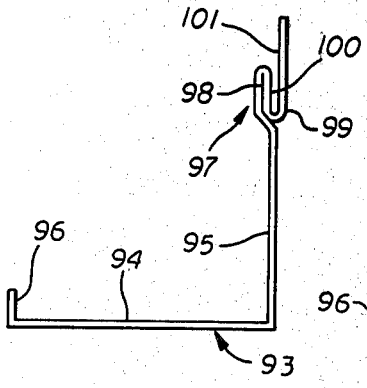
FIG. 5 is an end view of a half section of sheet metal having the edges bent to form a "Pittsburgh Lock", but prior to closing the edges into a locked position.
Figure 6:
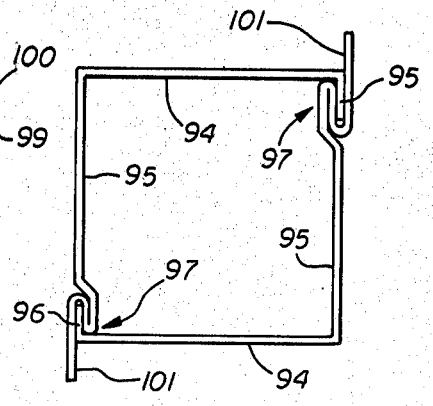
FIG. 6 is an end view showing two of the sheet metal sections, as shown in FIG. 5, assembled into a duct, but prior to closing the joints therein.

In FIG. 5, there is shown one piece 93 of sheet metal duct work with a "Pittsburgh Lock" formed therein for use in formation of a two piece sheet metal duct. The section 93 of duct work has two walls 94 and 95 joined by a right angle bend. Wall 94 has a small flange 96 bent at a right angle thereto. At the upper end of wall 95 there is provided the female section 97 of the "Pittsburgh lock". This female section 97 consists of portion 98 which rebent 180° into a tight bend and then rebent again as indicated at 99 to form a continuous slot 100 with a protruding sheet metal edge 101. In FIG. 6, two sections 93 are fitted together with flanges 96 inserted into the female recess 100 of "Pittsburgh Lock" 97 and the sheet metal edge 101 still extending in an unbent position. To complete the formation of the "Pittsburgh Lock" the protruding sheet metal edge 101 is bent over to the position shown in FIG. 7. This bending is usually accomplished by hand by means of a suitable hammer or occasionally by a portable powered hammering tool.

Figure 7:
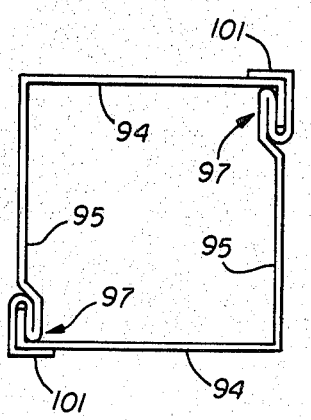
FIG. 7 is an end view of the sheet metal duct shown in FIG. 6 after bending the edges to close the "Pittsburgh Lock".
Figure 8:
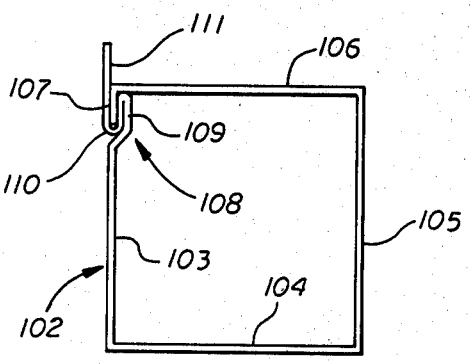
FIG. 8 is an end view of a one piece sheet metal duct having the "Pittsburgh Lock" in position for seaming or closing.
Figure 9:
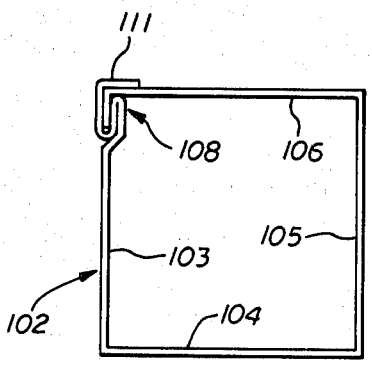
FIG. 9 is an end view of a one piece sheet metal duct having the "Pittsburgh Lock" bent over and closed.

In FIGS. 8 and 9, there is shown a one piece sheet metal duct 102 having sides 103, 104, 105 and 106 bent in right angle bends as indicated. At the end of wall 106 there is a bent flange 107 which corresponds to flange 96 in FIG. 5. At the end of wall 103 there is a "Pittsburgh Lock" 108 which is of the same construction as shown in FIGS. 5, 6 and 7. This consists of rebent portion 99 having a female slot or recess 110 with extending sheet metal portion 111. To complete the formation of this joint, the protruding sheet metal edge 111 is bent over as shown in FIG. 9.

In FIG. 10, the rotary hammer 63 is shown as it moves along "Pittsburgh Lock" 108 to bend protruding edge 111 to a closed position. The rotation of disc 77 and hammer abutments 78 thereon causes the hammer abutments to engage protruding edge 111 sequentially and continuously to bend over the edge 111 to form a tightly closed lock as shown in FIG. 10.

In considering the operation of the apparatus described above, it should be noted that sheet metal duct work comes in a large variety of sizes depending upon the required capacity of the ducts. Thus, very small ducts may be used for low capacity heating or air conditioning systems or for systems having very high velocity air flows. Larger ducts may be used for larger capacity systems, for gravity circulation systems, and for return air ducts where a number of separate air flows may be combined into a single large duct returning to the furnace or heater or air conditioning unit. It should also be noted that duct work is usually made in sections of uniform length for ease of handling. The sections are designed to be assembled end to end. One particular method of assembly utilizes a projecting edge on two opposite sides of the duct which fits into a female fold on the rear end of the adjacent duct. The other two sides of each of the ducts are provided with reverse bends onto which there is driven a clamping sleeve. In forming sheet metal ducts, it is necessary that the duct be assembled accurately so that it is not crooked or skewed and the connecting portions are in a proper position for assembly of the ducts.

In using the equipment described above, the description of operation will first be given with respect to a one-piece duct of the type shown in FIGS. 8 and 9. In assembling a duct of this type, the duct is assembled to the position shown in FIG. 8 with the unbent edge 111 of the "Pittsburgh Lock" 108 protruding above the upper wall 106 of the duct. The supporting table 29 is raised to the desired elevation by actuation of handle 46 of hydraulic pump 45. Table 29 is raised to a position such that the rotation of disc 77 of rotary hammer 63 will cause hammer posts 78 to engage and bend over the protruding edge 111 of "Pittsburgh Lock" 108 to the bent position shown in FIG. 9. The adjustment of the level of table 29 is such that the posts 78 of rotary hammer 63 will just clear the surface of the bent over and closed "Pittsburgh LocK" as shown in FIGS. 9 and 10.

The duct in its unformed state as seen in FIG. 8 is placed on table 29 in preparation for bending and closing the "Pittsburgh Lock". At the start of the operation the carriage 62 which suppots rotary hammer 63 is in its normal starting position at the extreme right of the apparatus adjacent to limit switch 92. The clamping member 61 is retracted as seen in FIG. 1. The duct is slid into the space between clamping member 61 and the forward, vertical face of frame member 26. The bottom of the duct is slid along the surface of stop member 50 and into stop 52 at one end.

This movement brings the end of the duct into abutment with the end member 56 of pneumatic spring 54. The pneumatic spring 54 is retracted slightly by this movement and the other end of the duct is brought against the surface of stop member 50. The duct is then pushed by the force of pneumatic spring 54 to the point where the other end engages stop member 53 on frame member 26 and stop member 51 on the back stop 50. Stop 53 is hinged at **53*a* to be moved out of the way when the duct is inserted or removed. In this position, the end connecting portions of the duct are positioned squarely for formation of the tightly closed "Pittsburgh Lock" joint. At this point, fluid actuated cylinders 57 and 58 are operated to cause clamping member 61 to clamp the rear wall 103 of the duct against the forward vertical surface of frame member 26**. The duct is held tightly by this clamp during the joint closing operation.

In the position just described, the rotary hammer 63 has a substantial clearance from the upper surface of frame member 26 but is positioned relative to the protruding edge 111 of "Pittsburgh Lock" 108 so that on rotation of disc 77 the hammer posts 78 will engage the protruding edge 111 sequentially and continuously to bend over and close the "Pittsburgh Lock". Lever 90 is then operated to energize motors 80 and 75.

Motor 80 actuates the traversing mechanism for moving the carriage 62 along the supporting track formed of rails 19 and 20. Motor 80 rotates drive sprocket 83 and causes drive chain 87 to move carriage 62 along the length of the track. Simultaneously, motor 75 rotates disc 77 and hammer posts 78 at a high rate of speed to provide a sequential and continuous hammering operation.

The movement of carriage 62 causes rotary hammer 63 to be moved along the length of the duct in accurate alignment with the corner of the duct where the "Pittsburgh Lock" joint is to be closed. The carriage 62 moves the rotary hammer 63 along the length of the duct and causes the "Pittsburgh Lock" joint to be closed as shown in FIG. 10. When carriage 62 reaches the end of its travel, it engages limit switch 91 which causes motor 80 to reverse and return carriage 62 to its starting point where the operation is stopped by engagement with limit switch 92.

At this point, fluid operated clamping cylinders 57 and 58 are deenergized causing clamping member 61 to retract and the finished duct is then removed manually from the apparatus. In this apparatus, table 29 is adjustable to accommodate various sizes of sheet metal ducts. The position of limit switch 91 is adjustable to vary the length of the path of movement of carriage 62. The stops 51 and 53 are also adjustable to accommodate various lengths of sheet metal duct work. In the alternate embodiment, shown in FIG. 4, a pivoted clamping arrangement is used which is advantageous for certain types of duct work.

When the apparatus is used for closing "Pittsburgh Lock" joints on two piece sheet metal ducts, the operation substantially the same as described above. The only difference is that two separate joint-clsoing operations are required. In forming a two piece sheet metal duct, one of the joints is fitted together somewhat in the manner of the arrangement shown in FIG. 6. The assembly would differ from that shown in FIG. 6 in that the joint in the lower left hand corner would be left loose when the partially assembled duct was placed in the apparatus for closing the joint in the upper right hand corner. After that joint is closed, the duct is removed from the clamps, the remaining joint assembled and put into the apparatus, and the joint formed as previously described.

While this invention has been described fully and completely with special emphasis upon two preferred embodiments, it should be understood that within the scope of the appended claims the invention may be practiced otherwise than as specifically described and shown herein.

I claim:

1. An automatic machine for closing Pittsburgh Lock joints in the corners of sheet metal conduits of square or rectangular cross-section comprising a supporting frame, a powered rotary hammer, means supporting said rotary hammer on said frame for reciprocal longitudinal movement thereon, motor means for moving said rotary hammer reciprocally on said supporting means for a predetermined distance, said frame including a portion extending longitudinally thereof and providing a vertically extending clamping surface positioned along and beneath the path of movement of said rotary hammer on said hammer supporting means, means for clamping one wall of an unformed sheet metal conduit of square or rectangular cross-section, having an unformed Pittsburgh Lock joint at a corner thereof, against said clamping surface to position said wall with the unbent portion of said joint vertically beneath said hammer path of movement and another wall of said conduit surrounding said clamping means and having an edge portion formed to mate with said unbent joint portion so that said reciprocal and rotary movement of said hammer is effective to bend said unbent portion into a tightly closed Pittsburgh Lock joint.

2. An automatic closing machine for sheet metal joints according to claim 1 in which said rotary hammer comprises a rotary shaft, motor means for rotating said shaft, a disc shaped supporting member supported on said shaft for rotation thereby, a plurality of hammer posts supported in a circular pattern on said disc and operable upon rotation to engage the sheet metal edge with continuous and repeated hammer blows, and said rotary hammer being supported at an inclined angle such that rotary movement of the respective hammer posts will be upward and away from the joint being formed after bending the sheet metal to form said joint.

3. An automatic closing machine for sheet metal joints according to claim 1 in which said frame includes means for supporting said sheet metal wall portion in a selected vertical spacing from said hammer path of movement, and means for adjusting said supporting means to adjust the position of said shet metal wall portion relative to the path of movement of said hammer supporting means to accomodate sheet metal ducts of different sizes.

4. An automatic closing machine for sheet metal joints according to claim 3 in which said frame includes a supporting table portion for the sheet metal duct in which a joint is to be closed, and means for adjusting the position of said supporting table vertically relative to said rotary hammer supporting means.

5. An automatic closing machine for sheet metal joints according to claim 4 in which said rotary hammer supporting means comprises a track supported on and extending longitudinally of said frame and supporting said rotary hammer for movement thereon.

6. An automatic closing machine for sheet metal joints according to claim 5 in which said supporting table adjusting means comprises a scissors type support for said table, and motor means for operating said scissors type support to move said supporting table to a predetermined vertical position relative to said rotary hammer supporting track and said vertical clamping surface.

7. An automatic closing machine for sheet metal joints according to claim 1 in which said frame includes stop means for positioning the cooperating edge portions forming said Pittsburgh Lock joint in a predetermined position along said vertical clamping surface relative to the path of reciprocal movement of said rotary hammer to assure accurate closing of said joint in relation to the ends of the duct.

8. An automatic closing machine for sheet metal joints according to claim 7 in which said stop means comprises a fixed stop at one end and a spring loaded stop at the other end of said vertical supporting surface operable to hold said conduit one wall portion therebetween.

9. An automatic closing machine for sheet metal joints according to claim 1 in which said motor means for reciprocally moving said rotary hammer includes adjustable means for varying the length of the path of movement of said rotary hammer.

10. An automatic closing machine for sheet metal joints according to claim 1 in which said sheet metal supporting means comprises power operated clamping means movable relative to said vertical clamping surface to clamp said one sheet matal wall therebetween.

11. An automatic closing machine for sheet metal joints according to claim 1 in which said motor means and the power for said rotary hammer comprise fluid operated motors.

12. An automatic closing machine for sheet metal joints according to claim 1 in which said motor means and the power for said rotary hammer comprise electric motors.

13. An automatic closing machine for sheet metal joints according to claim 1 in which said rotary hammer comprises a rotary shaft, motor means for rotating said shaft, a disc shaped supporting member supported on said shaft for rotation thereby, a plurality of hammer posts supported in a circular pattern on said disc and operable upon rotation to engage the sheet metal edge with continuous and repeated hammer blows, said rotary hammer being supported at an inclined angle such that rotary movement of the respective hammer posts will be upward and away from the joint being formed after bending the sheet metal to form said joint, said frame includes means for supporting said sheet metal wall portion in a selected vertical spacing from said hammer path of movement, and means for adjusting said supporting means to adjust the position of said shet metal wall portion relative to the path of movement of said hammer supporting means to accomodate sheet metal ducts of different sizes, and said frame includes stop means for positioning sheet metal ducts, on which joints are to be closed, in a predetermined position along said vertical clamping surface relative to the path of reciprocal movement of said rotary hammer to assure accurate closing of said joint in relation to the ends of the duct.

14. An automatic closing machine for sheet metal joints according to claim 13 in which said motor means for reciprocally moving said rotary hammer includes adjustable means for varying the length of the path of movement of said rotary hammer, and said sheet metal supporting means comprises power operated clamping means movable relative to said vertical clamping surface to clamp said one sheet matal wall therebetween.

15. An automatic closing machine for sheet metal joints according to claim 14 in which said frame includes a supporting table portion for the sheet metal duct in which a joint is to be closed, means for adjusting the position of said supporting table vertically relative to said rotary hammer supporting means, and said rotary hammer supporting means comprises a track supported on and extending longitudinally of said frame and supporting said rotary hammer for movement thereon.

16. An automatic closing machine for sheet metal joints according to claim 15 in which said supporting table adjusting means comprises a scissors type support for said table, and motor means for operating said scissors type support to move said supporting table to a predetermined vertical position relative to said rotary hammer supporting track.

* * * * *